US009677859B1

(12) United States Patent
Kim et al.

(10) Patent No.: US 9,677,859 B1
(45) Date of Patent: Jun. 13, 2017

(54) LIGHTED ARROW NOCK

(71) Applicants: Jae Woo Kim, Seongnam-si (KR); Jong Sang Lee, Seongnam-si (KR)

(72) Inventors: Jae Woo Kim, Seongnam-si (KR); Jong Sang Lee, Seongnam-si (KR)

( * ) Notice: Subject to any disclaimer, the term of this patent is extended or adjusted under 35 U.S.C. 154(b) by 0 days.

(21) Appl. No.: 15/007,496

(22) Filed: Jan. 27, 2016

(30) Foreign Application Priority Data

Nov. 27, 2015 (KR) ..... 10-2015-0167299

(51) Int. Cl.
*F42B 6/06* (2006.01)

(52) U.S. Cl.
CPC ..... *F42B 6/06* (2013.01)

(58) Field of Classification Search
CPC ..... F42B 6/04; F42B 6/06
See application file for complete search history.

(56) References Cited

U.S. PATENT DOCUMENTS 4,547,837 A * 10/1985 Bennett ..... F42B 6/06 200/60
6,736,742 B2 * 5/2004 Price ..... F42B 12/382 473/570
7,021,784 B2 * 4/2006 DiCarlo ..... F21V 33/008 362/109
7,837,580 B2 * 11/2010 Huang ..... F42B 6/06 473/570
7,931,550 B2 * 4/2011 Lynch ..... F42B 6/06 473/570
9,279,649 B2 * 3/2016 Bay ..... F42B 6/06
2016/0010961 A1 * 1/2016 Marshall, Jr. ..... F42B 12/382 473/570

* cited by examiner

*Primary Examiner* — John Ricci
(74) *Attorney, Agent, or Firm* — Cantor Colburn LLP

(57) ABSTRACT

A lighted arrow nock includes: a light emitting part having a light and a battery to allow the light to be moved forward and backward to and from battery to turn on and off the light; a driving circuit part disposed in the light to intermittently supply the power supplied from the battery to a light emitting diode chip of the light to allow the light to blink; an arrow coupling member having a cylindrical structure so that an outer peripheral surface thereof is inserted into the rear end of an arrow, while having the battery inserted into the inner space thereof; and a light operating member adapted to allow the light to be inserted into the lower portion thereof in the state of being inserted into the arrow coupling member and to move up and down.

3 Claims, 8 Drawing Sheets

LIGHTED ARROW NOCK

BACKGROUND OF THE INVENTION

Field of the Invention

The present invention relates to a lighted arrow nock, and more particularly, to a lighted arrow nock that is capable of allowing a light to blink, easily turning on or off the light, and being easily connected to an arrow.

Background of the Related Art

In general, an arrow 1 used for western archery includes, as illustrated in FIG. 1, an arrow shaft 10 having a cylindrical cross section made of duralumin, glass fiber, carbon fiber, or the like to form a body, an arrow head 20 fitted to the front end of the arrow shaft 10, feathers 30 designed to keep the direction of a trajectory upon flight of the arrow 1, and a nock 40 serving to lock a string thereon.

There has been recently developed a technology of providing the arrow with a light emitting function in order to enable a user to effectively enjoy games of archery even at night or on a cloudy day. In this case, a luminous light and a battery are provided to the rear end of the arrow, that is, on the nock 40, and the luminous light is turned on and off, so that the arrow has the light emitting function.

By the way, the conventional arrow with the light emitting function is complicated in the structure of turning on or off the luminous light, and actually, the operations of turning on or off the luminous light should be performed by means of a fine tool.

Further, the conventional arrow with the light emitting function is configured wherein the luminous light is kept turned on until artificially turned off, thus undesirably making the power of battery rapidly consumed and providing a relatively low degree of visibility.

SUMMARY OF THE INVENTION

Accordingly, the present invention has been made in view of the above-mentioned problems occurring in the prior art, and it is an object of the present invention to provide a lighted arrow nock that is capable of allowing a light to blink, easily turning on or off the light, and being easily connected to an arrow, thus extending the lifetime of a battery and improving the visibility of the arrow.

To accomplish the above-mentioned object, according to the present invention, there is provided a lighted arrow nock including: a light emitting part having a light and a battery in such a manner as to allow the light to be moved forward and backward to and from battery to turn on and off the light; a driving circuit part disposed in the light to intermittently supply the power supplied from the battery to a light emitting diode chip of the light to allow the light to blink; an arrow coupling member having a cylindrical structure so that an outer peripheral surface thereof is inserted into the rear end of an arrow, while having the battery inserted into the inner space thereof; and a light operating member adapted to allow the light to be inserted into the lower portion thereof in the state of being inserted into the arrow coupling member and to move up and down in the state of being inserted into the upper portion of the arrow coupling member to turn on and off the light.

According to the present invention, desirably, the light emitting part includes: the battery having a generally cylindrical shape; the light coupled to the battery and having the light emitting diode chip adapted to emit light by receiving the power of the battery; and a connector located between the light and the battery and adapted to turn on and off the light by means of the forward and backward movements of the light toward and from the battery, and the driving circuit part is installed on any one of electrode terminals of a lead frame at the interior of the light.

According to the present invention, desirably, the arrow coupling member includes: an arrow coupling portion having an insertion portion and a locking projection formed on the outer lower periphery thereof toward the intermediate portion thereof in such a manner as to be insertedly fitted to the rear end portion of the arrow; a battery insertion hole formed inside the arrow coupling portion to insert the battery thereinto; and a light operating member coupling hole formed at the interior thereof above the battery insertion hole to allow the lower periphery of the light operating member to be coupled thereto in such a manner as to be movable up and down.

According to the present invention, desirably, the arrow coupling portion further includes an arrow insertion reinforcement portion formed by incising a wall body of the arrow coupling member in such a manner as to have a higher thickness than the other portion of the wall body of the arrow coupling member.

According to the present invention, desirably, the light operating member includes: a light insertion groove formed at the inner peripheral surface of the lower portion thereof to insert the light thereinto in such a manner as to prevent the inserted light from being easily separated therefrom; an arrow coupling member insertion portion formed on the outer peripheral surface thereof in such a manner as to be inserted into the light operating member coupling hole; a guide rail formed on one side of the arrow coupling member insertion portion to guide a direction along which the light operating member is inserted into the light operating member coupling hole; and a position restricting portion formed on the opposite side to the guide rail on the arrow coupling member insertion portion to restrict the movements of on and off positions so as to turn on and off the light in the state wherein the light operating member is inserted into the light operating member coupling hole.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, an explanation on a lighted arrow nock according to the present invention will be in detail given with reference to the attached drawing.

Figure 1:
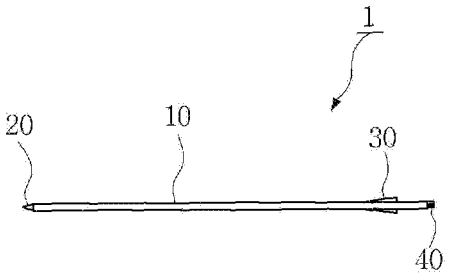
FIG. 1 Prior Art
FIG. 1 is a view showing a structure of a general arrow.
Figure 2:
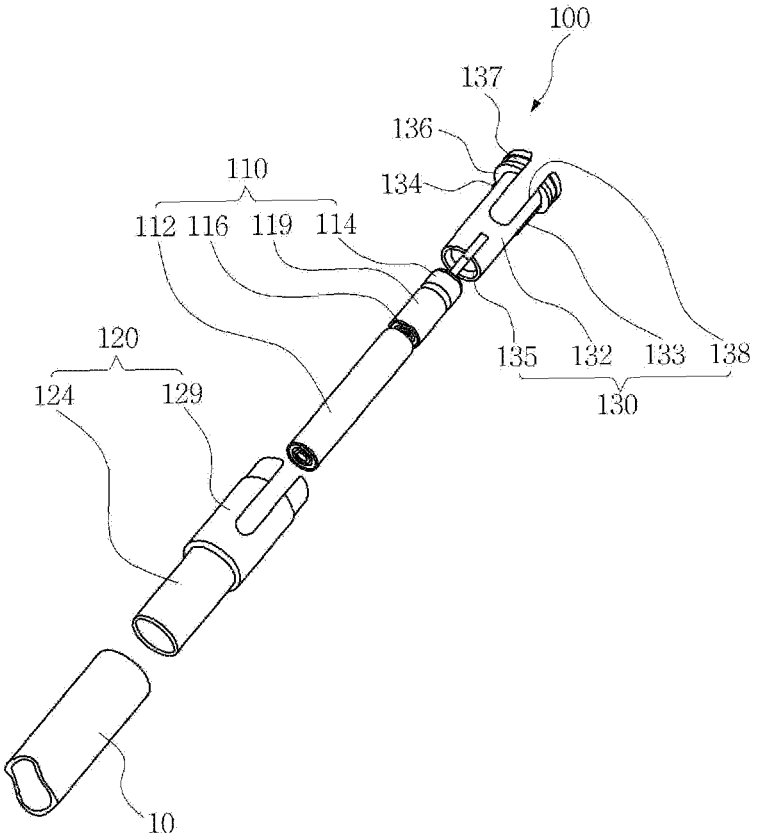
FIG. 2 is an exploded perspective view showing a lighted arrow nock according to a first embodiment of the present invention.

According to the present invention, as shown in FIG. 2, a lighted arrow nock largely includes a light emitting part 110, a driving circuit part 140, an arrow coupling member 120 and a light operating member 130.

Figure 5:
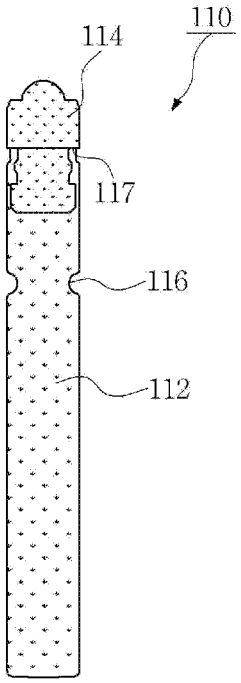
FIG. 5 is a sectional view showing a battery formed integrally with a light in the lighted arrow neck according to the first embodiment of the present invention.

First, the light emitting part 110 is a component for turning on and off a light 114 by means of forward and backward movements of the light 114 to and from a battery 112, and according to the present invention, in more detail, the light emitting part 110 includes, as shown in FIG. 5, the battery 112, the light 114 and a connector 119.

First, the battery 112 located at the lower side of the light emitting part 110 has a cylindrical shape, and the luminous light 114 is coupled above the battery 112 in such a manner as to have a structure wherein if the light 114 is pressed toward the battery 112, it is turned on, and if the light 114 pulls in the opposite direction to the battery 112, it is turned off.

Figure 3:
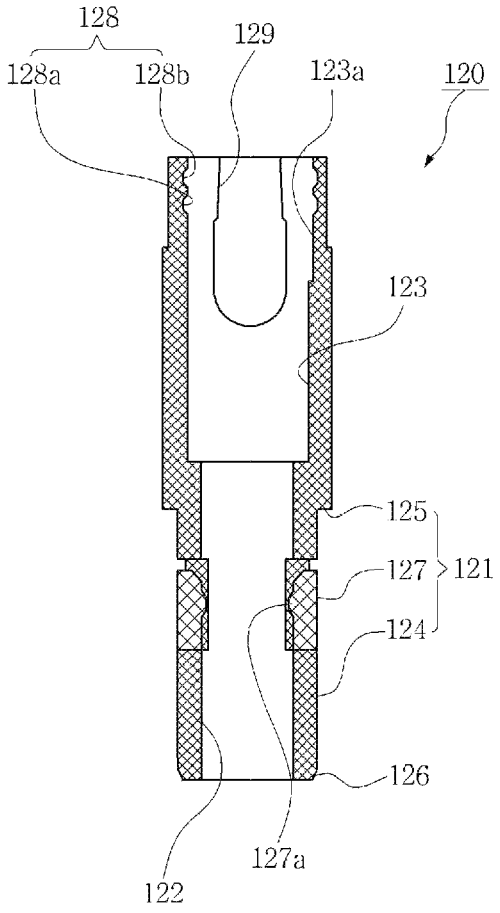
FIG. 3 is a sectional view showing a structure of an arrow coupling member in the lighted arrow nock according to the first embodiment of the present invention.

As shown in FIGS. 3 and 5, a protrusion insertion groove 116 is desirably formed on the intermediate outer periphery of the battery 112 in such a manner as to insert a protrusion 127*a* of the arrow coupling member 120 as will be discussed later thereinto.

At this time, as shown in FIG. 5, the light emitting part 110 desirably has an angled portion 117 formed on the surface of the luminous light 114 toward the battery 112. When the luminous light 114 is turned on and off by means of the light operating member 130 as will be discussed later, accordingly, the luminous light 114 is rigidly fitted to the light operating member 130 by means of the formation of the angled portion 117 to prevent the escape from the light operating member 130.

Further, the connector 119 is located between the light 114 and the battery 112 and serves to turn on and off the light 114 by means of the forward and backward movements of the luminous light 114 to and from the battery 112.

Figure 8:
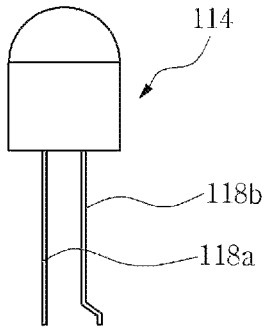
FIG. 8 is a view showing a structure of the luminous light according to the first embodiment of the present invention.

As shown in FIG. 8, the luminous light 114 includes lead wires 118*a* and 118*b* connected to the battery 112 and a luminous head in which an LED chip 113 is mounted. The luminous head has two lead terminals 111*a* and 111*b* connected to the lead wires 118*a* and 118*b* and the LED chip 113.

As shown in FIGS. 9 to 14, the driving circuit part 140 is disposed in the luminous light 114 and serves to intermittently supply the power supplied from the battery 112 to the LED chip 113 in the luminous light 114 to allow the luminous light 114 to blink. That is, the driving circuit part 140 includes an IC chip installed on any one of the two electrode terminals 111*a* and 111*b* to control the power supplied to the LED chip 113 so that the power is intermittently supplied with a given cycle. Accordingly, in the state where the luminous light 114 is turned on, the LED chip 113 is kept blinking.

Figure 15:
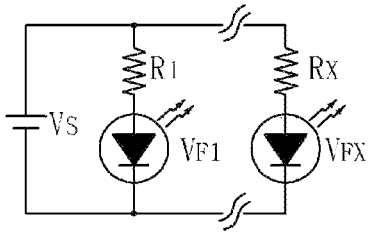
FIG. 15 is a circuit diagram showing the driving circuit part in the lighted arrow nock according to the present invention.

Accordingly, the driving circuit part 114 has a circuit configuration wherein the power supplied from the battery 112 is supplied or blocked with the given cycle, and of course, the driving circuit part 114 may have various circuit configurations. According to the present invention, for example, the driving circuit part 114 has a circuit configuration as shown in FIG. 15.

Figure 9:
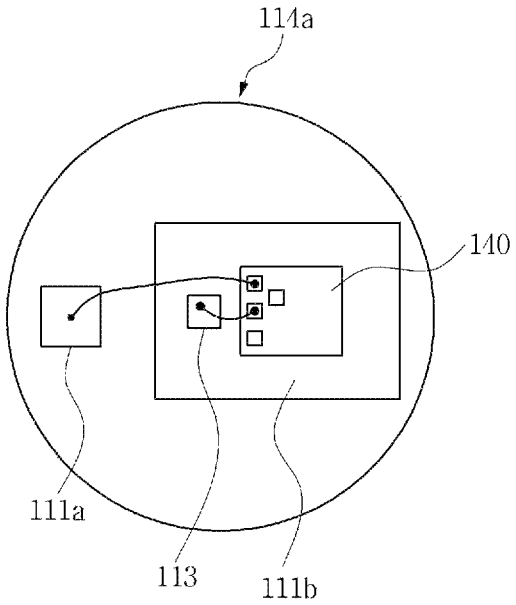
FIGS. 9 to 14 are views showing various examples of the luminous light and a driving circuit part in the lighted arrow nock according to the present invention.
Figure 10:
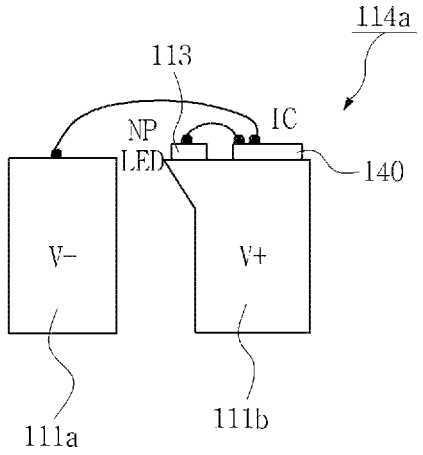
Figure 11:
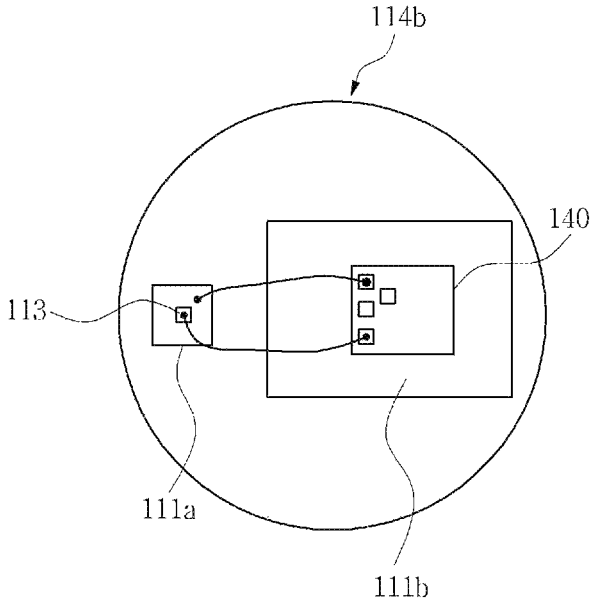
Figure 12:
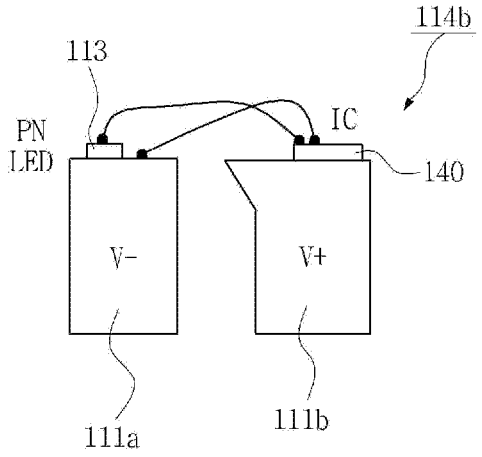
Figure 13:
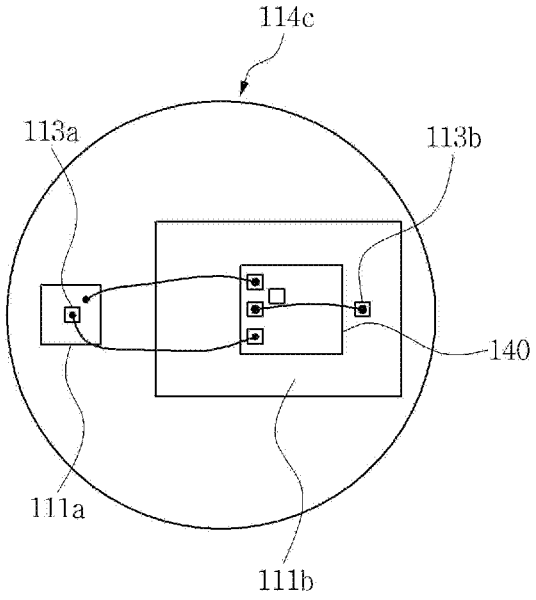
Figure 14:
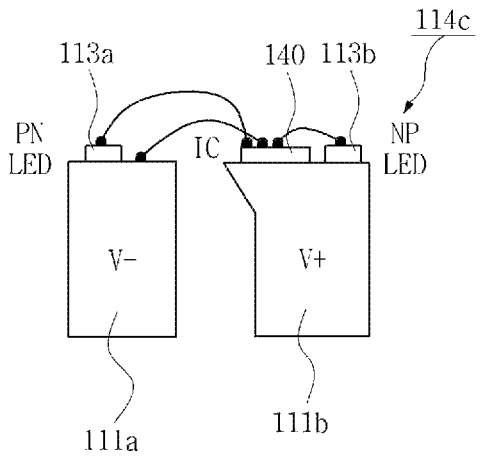

On the other hand, as shown in FIGS. 9 and 10, the driving circuit part 114 is disposed on the electrode terminal 111*b* on which the LED chip 113 is mounted, and contrarily, as shown in FIGS. 11 and 12, the driving circuit part 114 is disposed on the electrode terminal 111*a* on which the LED chip 113 is not mounted. Further, as shown in FIGS. 13 and 14, LED chips 113*a* and 113*b*, which emit different color lights from each other, are mounted on the electrode terminals 111*a* and 111*b*, and the driving circuit part 140 is disposed on any one of the electrode terminals 111*a* and 111*b*, so that the LED chips 113*a* and 113*b* are blinked, while emitting the two or more color lights.

Next, as shown in FIG. 2, the arrow coupling member 120 has a cylindrical structure so that an outer peripheral surface thereof is insertedly fitted to the rear end portion of an arrow shaft 10 and serves to insert the battery 110 formed integrally with the light 114 into the inner space thereof in the state wherein the light 114 is exposed to the outside. According to the present invention, that is, the arrow coupling member 120 serves to couple the lighted arrow nock 100 to the arrow shaft 10 in the state where the battery 110 formed integrally with the light 114 is inserted thereinto, and the light operating member 130 as will be discussed later is fastened to the arrow coupling member 120.

According to the present invention, as shown in FIGS. 2 and 3, the arrow coupling member 120 includes an arrow coupling portion 121, a battery insertion hole 122 and a light operating member coupling hole 123.

First, the arrow coupling portion 121 is formed on the outer lower periphery of the arrow coupling member 120. In more detail, as shown in FIG. 2, the arrow coupling portion 121 includes an insertion portion 124 having a given diameter insertedly fitted to the arrow shaft 10 and a locking projection 125 formed to lock the top end periphery of the arrow shaft 10 thereon in the state wherein the insertion portion 124 is insertedly fitted to the arrow shaft 10 by a given depth. Further, as shown in FIG. 3, the bottom end periphery of the arrow coupling portion 121 is tapered or rounded so that the arrow coupling portion 121 is easily insertedly fitted to the arrow shaft 10.

According to the present invention, desirably, the arrow coupling portion 121 further includes an arrow insertion reinforcement portion 127 adapted to reinforce the inserted state of the arrow coupling member 120 into the arrow shaft 10, without any escape from the arrow shaft 10. As shown in FIG. 3, the arrow insertion reinforcement portion 127 is formed by incising the intermediate portion of the wall body of the arrow coupling portion 121.

At this time, the lower end of the arrow insertion reinforcement portion 127 is not incised in such a manner as to be attached to the arrow coupling member 120, and the entire portion of the arrow insertion reinforcement portion 127 except the lower end thereof is incised on the arrow coupling portion 121, so that the arrow insertion reinforcement portion 127 can be elastically moved around the attached portion thereof. Further, the arrow insertion reinforcement portion 127 has a protruding portion 127*a* protruding inwardly from the inner peripheral surface of the arrow coupling member 120.

The protruding portion 127*a* pushes outwardly in the state where the battery 112 is inserted into the arrow coupling member 120, so that the arrow insertion reinforcement portion 127 is pressedly fitted to the inner peripheral surface of the arrow shaft 10. Accordingly, the arrow insertion reinforcement portion 127 is kept compressed between the battery 112 and the arrow shaft 10 to prevent the arrow coupling member 120 from being escaped from the arrow shaft 10.

Figure 6:
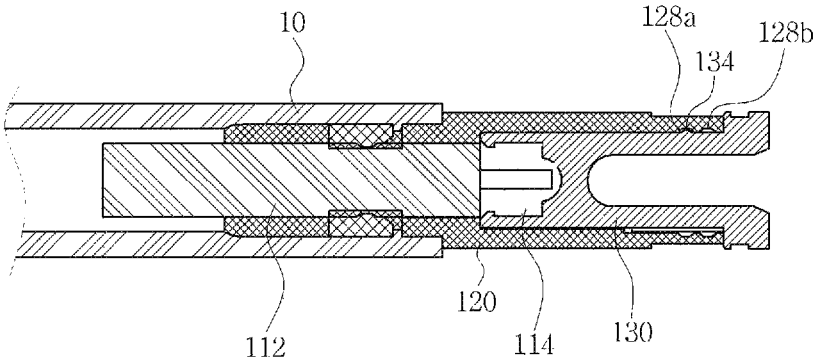
FIGS. 6 and 7 are views showing operating states of the lighted arrow nock according to the first embodiment of the present invention.
Figure 7:
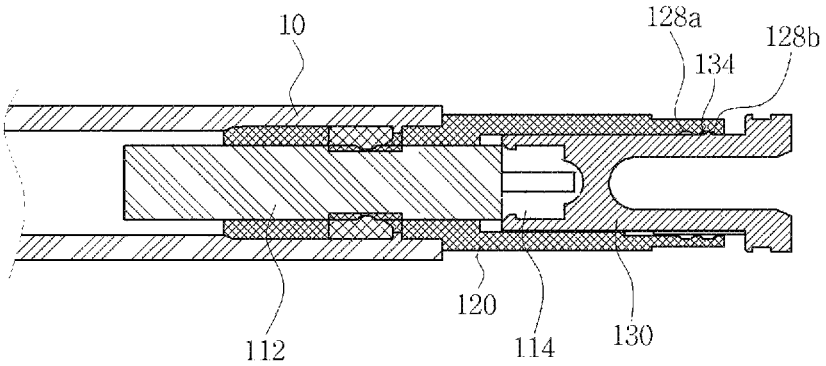

In the state where the arrow coupling member 120 is completely inserted into the arrow shaft 10, as shown in FIGS. 6 and 7, the protruding portion 127*a* is inserted into the insertion groove 116, so that the battery 112 and the arrow coupling member 120 are not separated from the arrow shaft 10 at all.

Next, as shown in FIG. 3, the battery insertion hole 122 is formed inside the arrow coupling portion 121 and serves to insert the battery 112 thereinto in the state where the battery 112 is inserted into the light operating member 130. Accordingly, the battery insertion hole 122 has the almost same inner diameter as the outer diameter of the battery 112 so that the cylindrical battery 112 can be inserted thereinto in such a manner as to be brought into close contact therewith. As a result, the battery 112 pushes the protruding portion 127*a* outwardly and is thus inserted into the battery insertion hole 122, so that the arrow insertion reinforcement portion 127 is compressed in the space between the battery 112 and the arrow shaft 10. As mentioned above, the protruding portion 127*a* is inserted into the insertion groove 116, thus finishing the rigid coupling between the arrow coupling member 120 and the arrow shaft 10.

Next, as shown in FIG. 3, the light operating member coupling hole 123 is formed above the battery insertion hole 122 and serves to allow the lower periphery of the light operating member 130 to be coupled thereto in such a manner as to be movable up and down. That is, a portion of the light operating member 130 is inserted into the light operating member coupling hole 123 in such a manner as to be moved up and down.

In this case, the light operating member coupling hole 123 has a somewhat larger diameter than the battery insertion hole 122, and the light operating member coupling hole 123 has on/off grooves 128 formed on the upper periphery thereof in such a manner as to be inserted into a position restricting portion 134 of the light operating member 130 as will be discussed later. As shown in FIG. 2, the on/off grooves 128 are two grooves spaced apart from each other in up and down directions in parallel with each other. That is, the groove formed on the lower periphery of the light operation member coupling hole 123 is an on groove 128*a*, and the groove formed on the upper periphery thereof is an off groove 128*b*. Operations of the on groove 128*a* and the off groove 128*b* will be in detail explained when the light operating member 130 is described below.

Further, as shown in FIG. 3, the light operating member coupling hole 123 has a rail groove 123*a* adapted to insert a rail 133 of the light operating member 130 thereinto. The rail groove 123 is formed downward from the top end periphery of the arrow coupling member 120 by a given depth in such a manner as to insert the rail 133 thereinto. Accordingly, if the rail 133 is inserted correspondingly into the rail groove 123*a* in the process where the light operating member 130 is inserted into the light operating member coupling hole 123, the light operating member 130 can be inserted into the light operating member coupling hole 123 at an accurate position.

According to the present invention, further, the arrow coupling member 120 includes an arrow string locking groove 129 formed thereon to lock an arrow string thereonto when the lighted arrow nock 100 is coupled to the arrow.

Next, as shown in FIGS. 2 and 6, the light operating member 130 inserts the luminous light 114 into the lower portion thereof so that when the light operating member 130 is inserted into the arrow coupling member 120, the luminous light 114 is exposed to the top side thereof, and serves to move up and down in the state of being inserted into the upper portion of the arrow coupling member 120 to allow the light 114 to be turned on and off. That is, according to the present invention, the light operating member 130 serves to turn on and off the light 114 of the light emitting part 110 inserted into the arrow coupling member 120.

Figure 4:
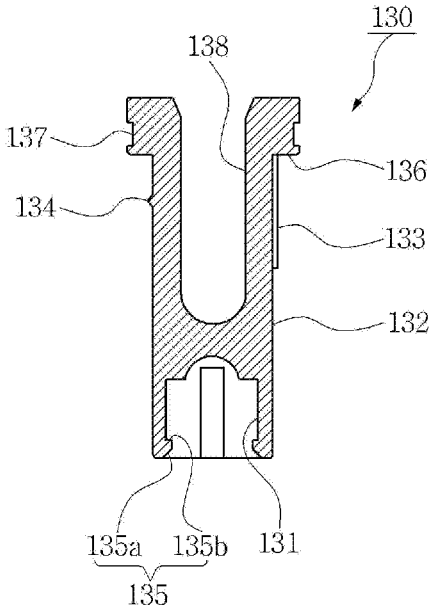
FIG. 4 is a sectional view showing a structure of a light operating member in the lighted arrow nock according to the first embodiment of the present invention.

According to the present invention, as shown in FIG. 4, the light operating member 130 includes a light insertion groove 131, an arrow coupling member insertion portion 132, a guide rail 133 and the position restricting portion 134.

First, as shown in FIG. 4, the light insertion groove 131 is formed at the inner peripheral surface of the lower portion of the light operating member 130 and serves to insert the luminous light 114 thereinto in such a manner as to prevent the inserted light 114 from being easily separated therefrom. Accordingly, the light insertion groove 131 has a locking portion 135 formed on the lower side thereof so as to lock the light 114 inserted thereonto. Further, the locking portion 135 has a slant surface 135*a* formed on the lower side thereof and a right angle surface 135*b* formed on the upper side thereof, so that in the process of inserting the light 114 into the light insertion groove 131, the insertion is easy, and after the insertion, the light 114 is not separated from the light insertion groove 131. The locking portion 135 is brought into close contact with the angled portion 117 formed on the lower side of the light 114 so as to prevent the on/off operations of the light 114 from being malfunctioned.

Further, as shown in FIG. 4, the whole shape of the light insertion groove 131 desirably has the corresponding shape to the shape of the luminous light 114.

Next, as shown in FIG. 2, the arrow coupling member insertion portion 132 is formed on the outer peripheral surface of the light operating member 130 in such a manner as to be inserted into the light operating member coupling hole 123. Accordingly, the arrow coupling member insertion portion 132 has a given size so that it can be inserted into the light operating member coupling hole 123 of the arrow coupling member 120 and has a locking projection 136 formed on the upper end periphery thereof so as to lock the top end periphery of the arrow coupling member 120 thereonto. Accordingly, the arrow coupling member insertion portion 132 is not inserted into the arrow coupling member 120 over the locking projection 136.

Next, as shown in FIG. 4, the guide rail 133 is formed on one side of the arrow coupling member insertion portion 132 and serves to guide a direction along which the light operating member 130 is inserted into the light operating member coupling hole 123. The guide rail 133 is disposed on the opposite side to the position restricting portion 134 so as to guide the accurate insertion of the light operating member 130 into the light operating member coupling hole 123. In more detail, the guide rail 133 protrudes elongatedly along the longitudinal direction of the light operating member 130 and is inserted into the rail groove 123*a* formed on the arrow coupling member 120 to guide the accurate insertion of the light operating member 130.

Next, as shown in FIG. 4, the position restricting portion 134 is formed on the opposite side to the guide rail 133 on the arrow coupling member insertion portion 132 and serves to restrict the movements of on and off positions so as to turn on and off the light 114 in the state wherein the light operating member 130 is inserted into the light operating member coupling hole 123. In this case, as shown in FIG. 6, the on position indicates a position at which the luminous light 114 is pressed toward the battery 112 and thus turned on, and as shown in FIG. 7, the off position indicates a position at which the luminous light 114 pulls in the opposite direction to the battery 112 and thus turned off.

That is, the position restricting portion 134 moves the luminous light 114 toward the battery 112 or in the opposite direction to the battery 112 in the state where the light operating member 130 is coupled to the luminous light 114, so as to guide the light operating member 130 to the accurate positions at which the luminous light 114 is turned on and off.

In more detail, as shown in FIGS. 2 and 4, the position restricting portion 134 protrudes on the opposite side to the guide rail 133 from the outer peripheral surface of the arrow coupling member insertion portion 132 in such a manner as to be inserted into the on/off grooves 128 to allow the luminous lamp 114 to be located at the on position and the off position.

That is, as shown in FIG. 6, if the position restricting portion 134 is set to a position (that is, the on position) fitted to the on groove 128*a*, the luminous light 114 is pressed toward the battery 112 and thus turned on, and contrarily, as shown in FIG. 7, if the position restricting portion 134 is set to a position (that is, the off position) fitted to the off groove 128*b*, the luminous light 114 pulls in the opposite direction to the battery 112 and thus turned off.

So as to change the positions of the position restricting portion 134, at this time, the upper end portion of the light operating member 130 is grasped by a user's hand and then presses toward the arrow coupling member 120 or pulls in the opposite direction to the arrow coupling member 120. Accordingly, as shown in FIG. 4, the light operating member 130 has grasping grooves 137 formed on the upper end periphery thereof so as to easily insert the user's nails thereinto, without having any slipping.

In the same manner as the arrow coupling member 120, on the other hand, the light operating member 130 has an arrow string locking groove 138 adapted to insert the arrow string thereinto in the process of using the arrow.

As described above, the lighted arrow nock according to the present invention is configured wherein the light is kept blinking in the state of being turned on, so that the lifetime of the battery is longer than that of the light kept turned on. Further, since the lighted arrow nock is kept blinking, it has more excellent visibility than that kept turned on, so that it can be more easily used even at night.

Furthermore, since the on/off operations of the lighted arrow nock are performed by the simple manipulation, such as pressing or pulling, of the light operating member, the present invention has an advantage of easy use. Also, since the nock consists of the arrow coupling member and the light operating member, the lighted arrow nock is firmly engaged with the arrow shaft, and the lighted arrow light is easily operated. In addition, since the battery is provided integrally with the light, the configuration is simple, and additional wiring is not necessary.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A lighted arrow nock comprising:

a light emitting part having a light and a battery in such a manner as to allow the light to be moved forward and backward to and from battery to turn on and off the light;

a driving circuit part disposed in the light to intermittently supply the power supplied from the battery to a light emitting diode chip of the light to allow the light to blink;

an arrow coupling member having a cylindrical structure so that an outer peripheral surface thereof is inserted into the rear end of an arrow, while having the battery inserted into the inner space thereof; and a light operating member adapted to allow the light to be inserted into the lower portion thereof in the state of being inserted into the arrow coupling member and to move up and down in the state of being inserted into the upper portion of the arrow coupling member to turn on and off the light, wherein the light emitting part comprises: the battery having a generally cylindrical shape; the light coupled to the battery and having the light emitting diode chip adapted to emit light by receiving the power of the battery; and a connector located between the light and the battery and adapted to turn on and off the light by means of the forward and backward movements of the light toward and from the battery, and the driving circuit part is installed on any one of electrode terminals of a lead frame at the interior of the light, and wherein the arrow coupling member comprises: an arrow coupling portion having an insertion portion and a locking projection formed on the outer lower periphery thereof toward the intermediate portion thereof in such a manner as to be insertedly fitted to the rear end portion of the arrow; a battery insertion hole formed inside the arrow coupling portion to insert the battery thereinto; and a light operating member coupling hole formed at the interior thereof above the battery insertion hole to allow the lower periphery of the light operating member to be coupled thereto in such a manner as to be movable up and down.

2. The lighted arrow nock according to claim 1, wherein the arrow coupling portion further comprises an arrow insertion reinforcement portion formed by incising a wall body of the arrow coupling member in such a manner as to have a higher thickness than the other portion of the wall body of the arrow coupling member.

3. The lighted arrow nock according to claim 1, wherein the light operating member comprises:

a light insertion groove formed at the inner peripheral surface of the lower portion thereof to insert the light thereinto in such a manner as to prevent the inserted light from being easily separated therefrom;

an arrow coupling member insertion portion formed on the outer peripheral surface thereof in such a manner as to be inserted into the light operating member coupling hole;

a guide rail formed on one side of the arrow coupling member insertion portion to guide a direction along which the light operating member is inserted into the light operating member coupling hole; and a position restricting portion formed on the opposite side to the guide rail on the arrow coupling member insertion portion to restrict the movements of on and off positions so as to turn on and off the light in the state wherein the light operating member is inserted into the light operating member coupling hole.

* * * * *